United States Patent [19]

Ross et al.

[11] Patent Number: 4,520,645

[45] Date of Patent: Jun. 4, 1985

[54] FEEDING THIN FOIL-LIKE MATERIAL INTO A GAP BETWEEN A PAIR OF ROTATABLE ROLLS

[75] Inventors: Hugh M. Ross, Poole; Peter G. Grocock, Ringwood, both of England

[73] Assignee: Davy McKee (Poole) Limited, Poole, England

[21] Appl. No.: 458,708

[22] Filed: Jan. 17, 1983

[30] Foreign Application Priority Data

Jan. 26, 1982 [GB] United Kingdom ..... 8202181

[51] Int. Cl.[3] ..... B21B 39/02

[52] U.S. Cl. ..... 72/250; 72/183; 72/422; 226/97

[58] Field of Search ..... 72/250, 183, 422; 242/78; 226/95, 96, 97

[56] References Cited

U.S. PATENT DOCUMENTS 3,643,889 2/1972 Krause ..... 226/95

FOREIGN PATENT DOCUMENTS 1163760 2/1964 Fed. Rep. of Germany ..... 72/183

*Primary Examiner*—Lowell A. Larson
*Assistant Examiner*—Jorji M. Griffin
*Attorney, Agent, or Firm*—Schwartz & Weinrieb

[57] ABSTRACT

In a processing device which includes a pair of rotatable rolls and a support for supporting a coil of foil-like material, a device is provided for feeding the leading end of the outer turn of the coil of foil-like material into the gap between the rolls. The device comprises a structure which is movable along a path which brings it close to the periphery of the coil and to the roll gap. The structure includes suction apparatus for picking up the outer turn of the coil and apparatus for blowing air over a surface of the leading end of the foil to cause the leading end to tauten and enter into the roll gap.

12 Claims, 6 Drawing Figures

FEEDING THIN FOIL-LIKE MATERIAL INTO A GAP BETWEEN A PAIR OF ROTATABLE ROLLS

BACKGROUND OF THE INVENTION

In various industrial processes it is necessary to feed the leading end of a wide sheet of foil-like material into a gap between a pair of rotatable rolls. The term "foil-like" is not intended to signify that the material is necessarily of metal because other materials, such as paper, are passed between pairs of rolls, for example in a calender during the course of manufacture.

A particular application, however, is to the feeding of the leading end of a wide sheet of aluminium foil into the gap between the work rolls of a rolling mill. In such an application it is usual for a human operator to grip the longitudinal edges of the sheet and to urge them apart to hold the front edge of the leading end taut and to feed the leading end into the roll gap. If, however, the width of the sheet of material is wider than about four feet, it is not possible for one human operator to grip both longitudinal edges of the sheet of material.

OBJECTS OF THE INVENTION

It is an object of the present invention to provide a feeding device for feeding a wide sheet of foil-like material into the gap between a pair of rotatable rolls.

SUMMARY OF THE INVENTION

According to the present invention, a processing device has a pair of rotatable rolls which provide a gap therebetween; a support spaced from the rolls for supporting a coil of foil-like material; and a device for feeding the leading end of the outer turn of a coil of foil-like material on the support into said gap between the rolls, said feeding device comprising a structure comparable in length to the width of the foil-like material; suction means positioned on the structure; means for displacing the structure so that it moves in a direction normal to its length along a path which is close to the periphery of a coil on the support and close to the inlet side of the roll gap; and means on the structure for blowing air in the direction forwardly of the movement of the structure whereby, in use, the structure is displaced along the path to permit the suction means to pick up the outer turn of the coil close to the leading end thereof and position it close to the inlet side of the roll gap, and air blown over a surface of the leading end causes the leading end to tauten and enter into the roll gap.

The structure is conveniently connected to a telescopic support which enables the suction means to move close to the outer periphery of coils of various diameters on the coil support.

The suction means conveniently comprises a number of suction pads spaced apart across the length of the structure.

BRIEF DESCRIPTION OF THE DRAWINGS

In order that the invention may be more readily understood it will now be described, by way of example only, with reference to the accompanying drawings, in which.

DETAILED DESCRIPTION OF THE ILLUSTRATED EMBODIMENTS

Figure 1:
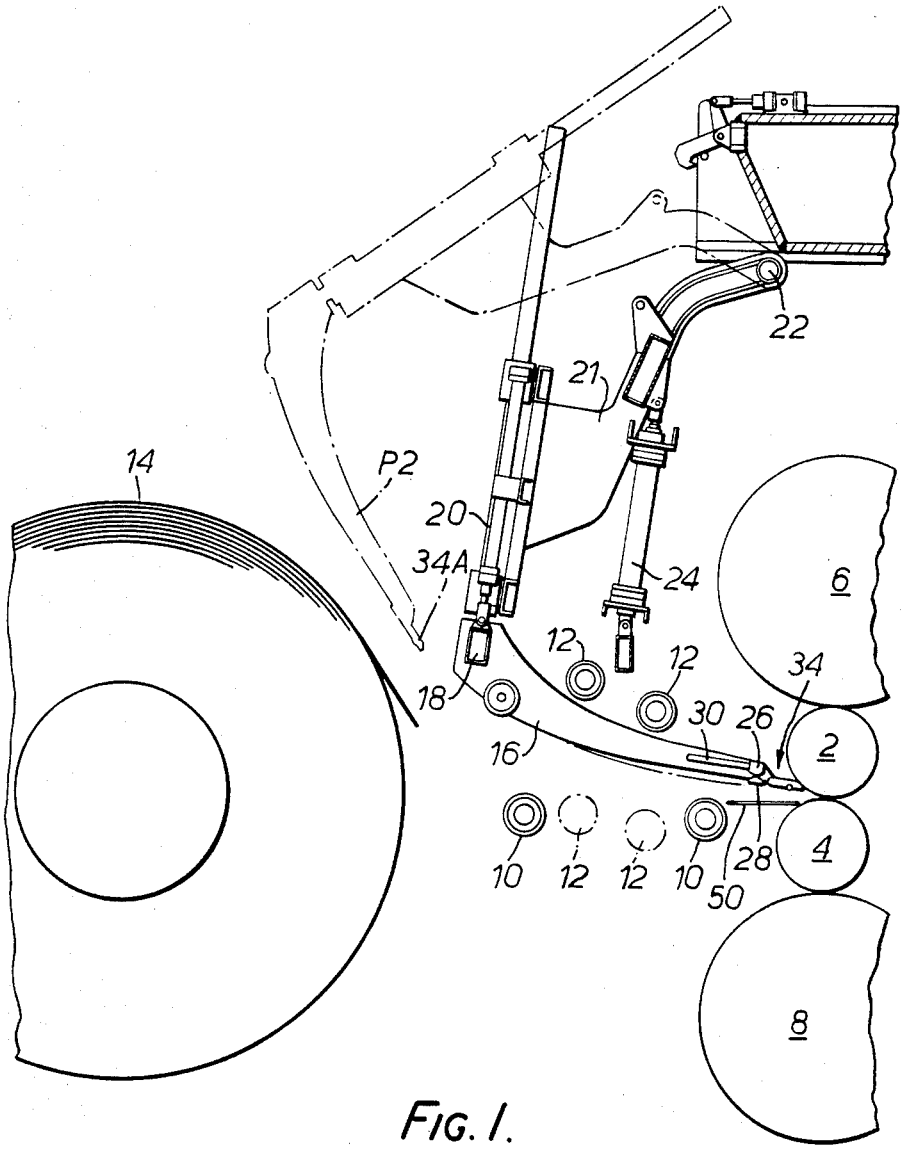
FIG. 1 shows diagrammatically a processing device according to the invention.

Referring to FIG. 1, a processing device in the form of a rolling mill has a pair of work rolls 2, 4, a pair of back-up rolls 6, 8, and a 4-roll bridle consisting of fixed rollers 10 and movable rollers 12. The fixed rollers form part of a feed table and the rollers 12 are movable into positions between the rollers 10, as indicated in chain lines, to provide tension to material fed between the work rolls. A support, not shown, enables a coil 14 of wide, (for example, 5–6 ft.), non-self-supporting foil-like material, such as aluminium foil, to be supported with the axis of the coil approximately 10 ft. from the roll gap.

A device for feeding the leading end of the material into the roll gap comprises a pair of curved plates 16, spaced apart by a transverse spacer 18, and the interconnected plates are supported on at least one telescopic support 20. The support is carried by a pair of links 21 which are pivoted at their topmost portions on pins 22 secured to the rolling mill frame. By means of a hydraulic piston and cylinder unit 24, the structure, comprising the links 21, support 20 and the plates 16, can be caused to swing about the pivot pins 22.

The telescopic support 20 enables the structure to move along paths which pass close to coils of different diameters on the coil support.

Figure 2:
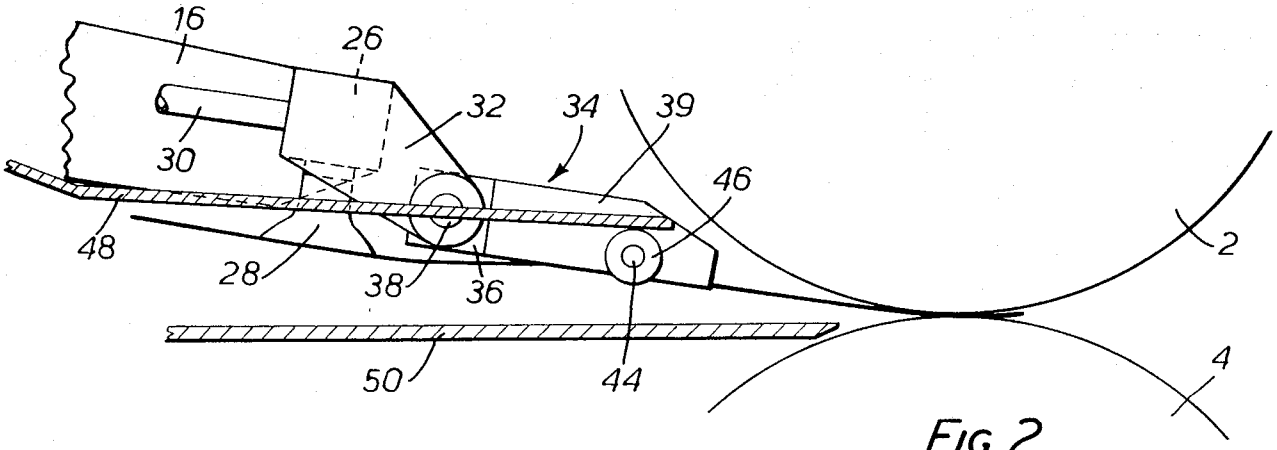
FIGS. 2 and 3 are side elevations, partly in section and to a larger scale, showing details of the foil feeding device.
Figure 3:
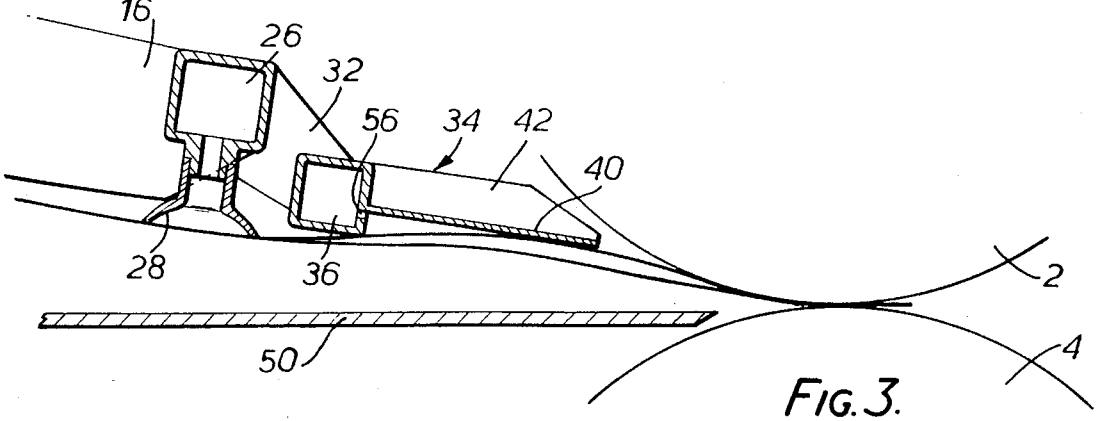
Figure 4:
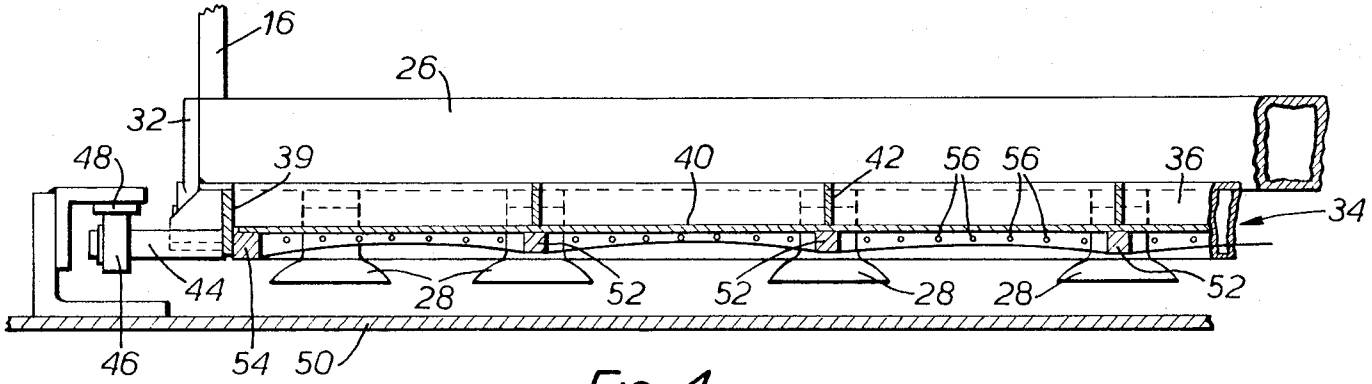
FIG. 4 is a front view of part of the foil feeding device.

At the extreme end of the plates 16 away from the spacer 18 is a transverse arm in the form of a hollow rectangular suction manifold 26, shown clearly in FIGS. 2, 3 and 4. The length of the arm is of the same order as the width of the foil material. A number of suction pads 28 are spaced apart along the length of the arm and a pipe 20 connects the manifold to a vacuum supply.

Figure 5:
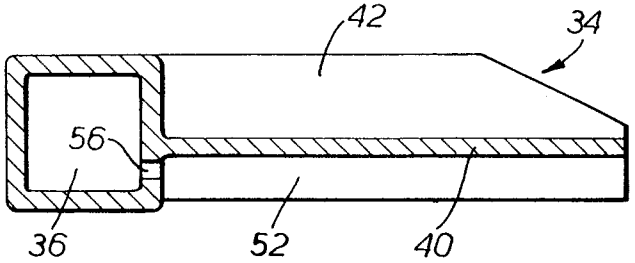
FIG. 5 is a section view of one part of the same device, but to a larger scale.

Depending from each end of the arm 26 are projections 32 and between these projections is pivoted an air jetting device 34. The device comprises a hollow rectangular tube 36, closed at its ends and rockable about pins 38 extending inwardly from the projections. End plates 39 on the tube 36 are provided and between those plates extends a web 40. Stiffening ribs 42 are provided on the upperside of the web to strengthen it. On at least one of the end plates is a fixed shaft 44 and a cam roller 46, rotatable on that shaft, co-operates with a cam plate 48 carried conveniently by a short pass-line table 50 positioned close to the rolls 2, 4. Conveniently, a torsion spring, not shown, urges the cam roller into contact with the underside of the cam plate when the device is in its operative position. When the device is not adjacent the roll gap, the torsion spring urges the device upwardly into a parked position, as illustrated in FIG. 1 at 34A. Beneath the web 40, and spaced transversely thereacross, is a series of bars 52 and a further bar 54 is positioned at each end of the web. The tube 36 is formed on one of its sides, and just below the level of the web 40, with a series of holes 56, (see particularly FIG. 5), spaced along the length of the structure. The tube is fed with a supply of compressed air through a convenient control valve (not shown).

In use, the coil 14 is supported on its support and rotated so as to position its leading end facing the rolls of the rolling mill, as seen in FIG. 1. The hydraulic piston and cylinder unit 24 is actuated to swing the feeding device about its pivot 22 from its parking position, (not shown), to a position, indicated at P2 where the suction pads are some twelve inches or so rearwardly of the leading end of the coil of material. The telescopic device is then energised to bring the suction pads 28 into contact with the foil and a valve, not shown, is actuated to connect the manifold 26 to the vacuum source, thus causing the coiled material to be gripped by the suction pads 28 where it is firmly held across its width. Piston and cylinder unit 24 is further actuated to swing the structure together with the suction device carrying the leading end portion of coiled material towards the roll gap. The coil is rotated to avoid undue tension in the material as this occurs. As the front end of the feeding device approaches the roll gap, cam roller 46 engages the underside of the cam plate 48 causing the air jet device 34 to be rocked downwardly about its pivot 38 against the action of its torsion spring, to take up its operative position as illustrated in the drawings. It will be realised that the first twelve inches or so of the material is unsupported at this stage and is, therefore, limp.

Since that material needs to be extended into the roll gap to feed it to the mill, the valve controlling the compressed air jets is actuated and compressed air is jetted through the holes 56 over the upper surface of the material. The effect of this is clearly seen in FIG. 3 and the leading end of the material is held in an almost horizontal position by the air flow over the upper surface. The short bars 52 are beneficial to this operation as they prevent the material lifting so high as to cause it to cling to the underside of the web 40. As seen in FIG. 4, an air passage is maintained between the web 40 and the material.

Once the leading end of the material fed from the coil has been inserted between the work rolls 2, 4, there is no further need for the air jets and so the valve controlling the supply of compressed air to the tube 36 is switched off. Similarly, the vacuum to the manifold 26 is removed, thus releasing the grip on the material by the suction pads. The piston and cylinder device 24 is actuated to rock the structure to its parking position. The bridle rolls 12 are lowered from the position, shown in full lines in FIG. 1, to their operative position, seen in chain lines, thus providing tension in the material between coil and mill rolls. Thereafter, the material is rolled through the mill in the normal manner.

Figure 6:
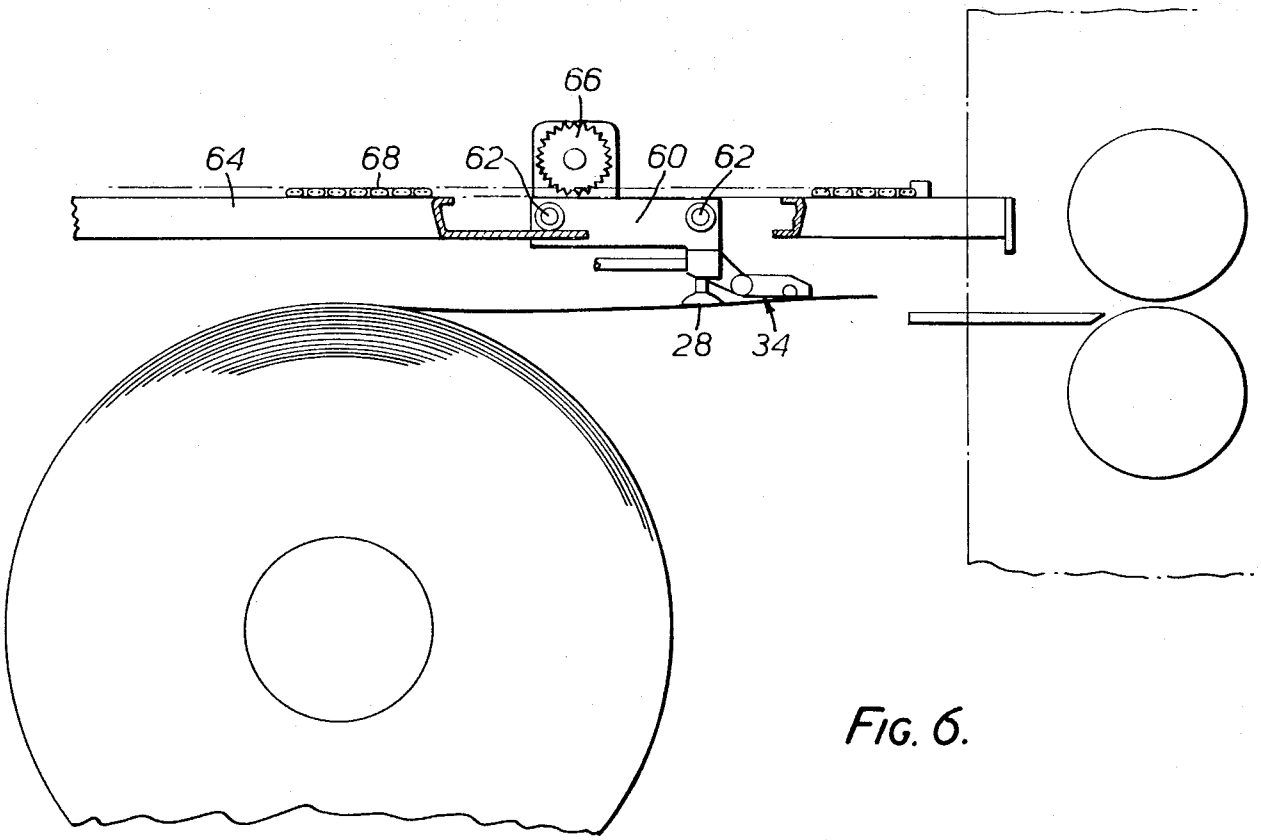
FIG. 6 shows diagrammatically an alternative form of the invention.

In the alternative embodiment, shown in FIG. 6, the air jetting device 34 and the suction pads 28 are as shown in FIGS. 1–4 but form part of a generally rectangular structure 60 provided with wheels 62. The wheels on the structure are guided by a generally horizontal track 64 and the structure is displaceable backwards and forwards along the track. The displacing means take the form of a pair of pinions, of which one is indicated by reference 61, which engage fixed racks 68 on the track. An electric motor on the structure rotates the pinions causing the structure to be displaced along the track.

Obviously, many modifications and variations of the present invention are possible in light of the above teachings. It is therefore to be understood that within the scope of the present claims, the present invention may be practiced otherwise than as specifically described herein.

What we claim as our invention and desire to secure by Letters Patent is:

1. Apparatus for feeding the leading end of the outer turn of a coil of web material into a gap defined between a pair of rotatable rolls, comprising:

a pair of rotatable rolls having a gap defined therebetween;

means for supporting a coil of web material at a location spaced from said pair of rotatable rolls;

a structure having a length comparable to the width of said web material;

means for moving said structure between said coil of web material and said pair of rotatable rolls so as to move said leading end of said outer turn of said coiled web material from said coiled web material location to said gap of said pair of rotatable rolls;

suction means mounted upon said structure for grasping said outer turn of said coiled web material at a predetermined distance rearwardly of said leading end of said web material; and means mounted upon said structure for blowing air past said leading end of said web material so as to properly orient said leading end of said web material relative to said gap defined between said pair of rotatable rolls and thereby facilitate the feeding of said leading end of said web material into said gap defined between said pair of rotatable rolls.

2. A processing device as claimed in claim 1, wherein the structure is pivotable about a fixed housing and a piston-cylinder device causes the structure to pivot about the housing.

3. A processing device as claimed in claim 2, wherein the structure includes a telescopic support which enables the structure to be moved towards and away from the support for the coil of web material.

4. A processing device as claimed in claim 1, in which the suction means comprises a plurality of suction pads spaced apart along the length of the structure and a connection from the pads to a vacuum source.

5. A processing device as claimed in claim 1, in which the air blowing means on the structure comprises a hollow member extending for substantially the length of the structure, a plurality of holes in the wall of the hollow member facing forwardly of the structure, and means for supplying air under pressure to the hollow member.

6. A processing device as claimed in claim 1, wherein the structure is provided with wheels which engage a fixed track and an electric motor serves to displace the carriage along the track.

7. Apparatus as set forth in claim 1, wherein:

said web material comprises aluminum foil.

8. Apparatus as set forth in claim 1, wherein:

said means for moving said structure between said coiled web material and said pair of rotatable rolls comprises means for moving said structure in an arcuate path between said coiled web material and said pair of rotatable rolls.

9. Apparatus as set forth in claim 1, wherein:

said means for moving said structure comprises means for moving said structure in a substantially radial direction relative to said coiled web material so as to permit said suction means to grasp said outer turn of said coiled web material.

10. Apparatus as set forth in claim 1, wherein:

said means for moving said structure comprises means for moving said structure in a substantially rectilinear path between said coiled web material and said pair of rotatable rolls.

11. Apparatus as set forth in claim 10, wherein:

said rectilinear path is disposed substantially tangentially to said coiled web material.

12. Apparatus as set forth in claim 1, wherein:

said air blowing means is disposed above said leading end of said web material so as to blow said air across the upper surface of said leading end of said web material.

* * * * *